US007731520B1

(12) United States Patent
Daily et al.

(10) Patent No.: US 7,731,520 B1
(45) Date of Patent: Jun. 8, 2010

(54) BLADE AND RECEPTACLE POWER CONNECTOR

(75) Inventors: Christopher George Daily, Harrisburg, PA (US); Matthew Edward Mostoller, Hummelstown, PA (US); Seth Fisher, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/209,340

(22) Filed: Sep. 12, 2008

(51) Int. Cl.
*H01R 13/627* (2006.01)

(52) U.S. Cl. ..... 439/357; 439/595; 439/680

(58) Field of Classification Search ..... 439/353, 439/357, 680, 284, 856, 746
See application file for complete search history.

(56) References Cited

U.S. PATENT DOCUMENTS

| | | | | |
|---|---|---|---|---|
| 2,384,267 | A * | 9/1945 | Andersen | 439/293 |
| 4,239,319 | A | 12/1980 | Gladd et al. | |
| 4,596,439 | A | 6/1986 | Ruehl et al. | |
| 4,654,743 | A | 3/1987 | Ruehl et al. | |
| 4,685,886 | A * | 8/1987 | Denlinger et al. | 439/55 |
| 4,917,624 | A | 4/1990 | Yu | |
| 4,963,102 | A | 10/1990 | Gettig et al. | |
| 5,034,846 | A | 7/1991 | Hodge et al. | |
| 5,412,248 | A | 5/1995 | Murari et al. | |
| 5,564,952 | A | 10/1996 | Davis | |
| 5,594,276 | A | 1/1997 | Murari et al. | |
| 5,664,969 | A * | 9/1997 | Peterson et al. | 439/746 |
| 5,879,192 | A | 3/1999 | Machida et al. | |
| 6,007,362 | A * | 12/1999 | Davis et al. | 439/358 |
| 6,299,492 | B1 * | 10/2001 | Pierini et al. | 439/884 |
| 6,319,075 | B1 * | 11/2001 | Clark et al. | 439/825 |
| 6,435,891 | B1 | 8/2002 | Beck, Jr. et al. | |
| 6,561,834 | B2 * | 5/2003 | Chen | 439/358 |
| 7,059,901 | B2 | 6/2006 | Morita et al. | |
| 2001/0049220 | A1 * | 12/2001 | Kodama | 439/357 |

FOREIGN PATENT DOCUMENTS

| | | |
|---|---|---|
| EP | 0895312 | 2/1999 |
| WO | WO 2004054037 | 6/2004 |

OTHER PUBLICATIONS

European Search Report, International Application No. 09170044.3 - 1231 International Filing Date, Nov. 19, 1930.

* cited by examiner

*Primary Examiner*—Hae Moon Hyeon

(57) ABSTRACT

An electrical connector for supplying power to a circuit board or the like. The electrical connector has a housing with contact receiving cavities extending from a wire-receiving face to a mating face. Alignment cavities are positioned adjacent the contact receiving cavities and extend from the mating face toward the wire-receiving face. Contacts are positioned in the contact receiving cavities. Each contact has a wire-receiving portion and a contact section. The wire-receiving portion has power wires terminated thereto, and the contact section is positioned in the contact receiving cavities proximate the mating face. A connector latch arm extends from the housing and has a latch projection provided proximate the mating face of the housing. The latch projection is movable relative to the housing.

17 Claims, 6 Drawing Sheets

BLADE AND RECEPTACLE POWER CONNECTOR

FIELD OF THE INVENTION

The present invention relates generally to electrical power connector assemblies and, more particularly, to electrical power connector assemblies for use with electrical panel members.

BACKGROUND OF THE INVENTION

Connector assemblies are required to provide electrical power or electrical or electronic control signals between components, such as computers, printers, auxiliary hardware, etc. Often, these components contain panel members, such as printed circuit boards, which are populated with miniaturized components to provide the desired electrical control. Typically, the connector assembly includes electrical contacts that extend from a housing that is secured adjacent to one end of the panel member. A mating connector assembly is configured for receiving the connector assembly. The operational reliability of the component is directly affected by the integrity of the connection. That is, if there is an insufficient electrical connection between the contacts, the components cannot operate as intended. In much of the prior art, the electrical connector assemblies between adjacent panel members are configured to permit coupling by directing the electrical connector assemblies toward each other in only one direction.

U.S. Publication Number 2008/0166901 A1 and Tyco Electronics Corporation Application Specification 114-13225 Rev B dated 5 May 8 disclose a connector assembly secured to a panel member for electrically coupling with a second connector assembly secured to a second panel member. Each of the connector assemblies includes a first contact having a first portion and a second portion disposed at a first predetermined spacing from each other. A second contact is disposed a second predetermined spacing from the second portion, the first predetermined spacing of the first contact being configured and disposed to receive the second contact of the second connector assembly. The second contacts and corresponding first contacts of the connector assembly and second connector assembly are capable of forming pivotable connections. This type of connector assembly provides various advantages including that i) the mating electrical connector assemblies can be brought together from different directions, ii) it reduces the number of component parts required to manufacture the connector assemblies, and iii) the connector assembly is hermaphroditic in nature.

While the connector assemblies provide an effective connection between panel members, there are currently no mounted connectors which will mate with the connector assemblies to connect power wires to the connector assemblies. It would be beneficial to provide a power connector which would allow for quick connect and disconnect of the power wires from the connector assemblies.

SUMMARY OF THE INVENTION

The invention is directed to an electrical connector for supplying power to a circuit board or the like. The electrical connector has a housing with contact receiving cavities extending from a wire-receiving face to a mating face. Alignment cavities are positioned adjacent the contact receiving cavities and extend from the mating face toward the wire-receiving face. Contacts are positioned in the contact receiving cavities. Each contact has a wire-receiving portion and a contact section. The wire-receiving portion has power wires terminated thereto, and the contact section is positioned in the contact receiving cavities proximate the mating face. A connector latch arm extends from the housing and has a latch projection provided proximate the mating face of the housing. The latch projection is movable relative to the housing.

The contact receiving cavities may have latch arm projections and retention shoulders which extend into securing sections of the contact receiving cavities. The latch arm projections and the retention shoulders cooperate with mounting shoulders of the contacts to retain the contacts in the contact receiving cavities. The latch arm projections may be provided on contact latch arms which can be resiliently displaced to move the latch arm projections out of the contact receiving cavities, thereby allowing the contacts to be removed from the contact receiving cavities.

The invention is also directed to an electrical connector having a housing with at least one receptacle contact receiving cavity and at least one blade-receiving contact cavity extending from a wire-receiving face to a mating face. Alignment cavities are positioned adjacent the at least one receptacle contact receiving cavity and the at least one blade contact receiving cavity. The alignment cavities extend from the mating face toward the wire-receiving face. A receptacle contact is positioned in the at least one receptacle contact receiving cavity. The receptacle contact has a receptacle wire-receiving portion and receptacle contact section, with the receptacle wire-receiving portion having a power wire terminated thereto and the receptacle contact section being positioned in the at least one receptacle contact receiving cavity proximate the mating face. A blade contact is positioned in the at least one blade contact receiving cavity. The blade contact has a blade wire-receiving portion and a blade contact section, with the blade wire-receiving portion having a power wire terminated thereto and the blade contact section being positioned in the at least one blade contact receiving cavity proximate the mating face. A connector latch arm extends from the housing; the connector latch arm has a latch projection proximate the mating face. The latch projection is movable relative to the housing.

The invention is also directed to an electrical connector having a housing with at least one receptacle contact receiving cavity extending from a wire-receiving face to a mating face. At least one alignment cavity is positioned adjacent the at least one receptacle contact receiving cavity. The at least one alignment cavity extends from the mating face toward the wire-receiving face. The at least one receptacle contact receiving cavity has walls with slots extending therethrough which define a mating contact receiving area. A receptacle contact is positioned in the at least one receptacle contact receiving cavity. The receptacle contact has a receptacle wire-receiving portion having a power wire terminated thereto and receptacle contact section positioned in the at least one receptacle contact receiving cavity proximate the mating face. The receptacle contact has resilient contact arms which align with the slots of the walls and which move into the slots of the walls when a mating connector is mated with the receptacle contact.

The use of the connector has many advantages, including the ability to provide power to a string of circuit boards or other systems using mating connectors already used on the circuit boards. The use of the connector also eliminates the user's need to solder power leads to the circuit board, thereby providing a much more reliable and effective source of power. As the connector can be easily disengaged when desired, the ability to repair or replace the circuit boards or other components is enhanced.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
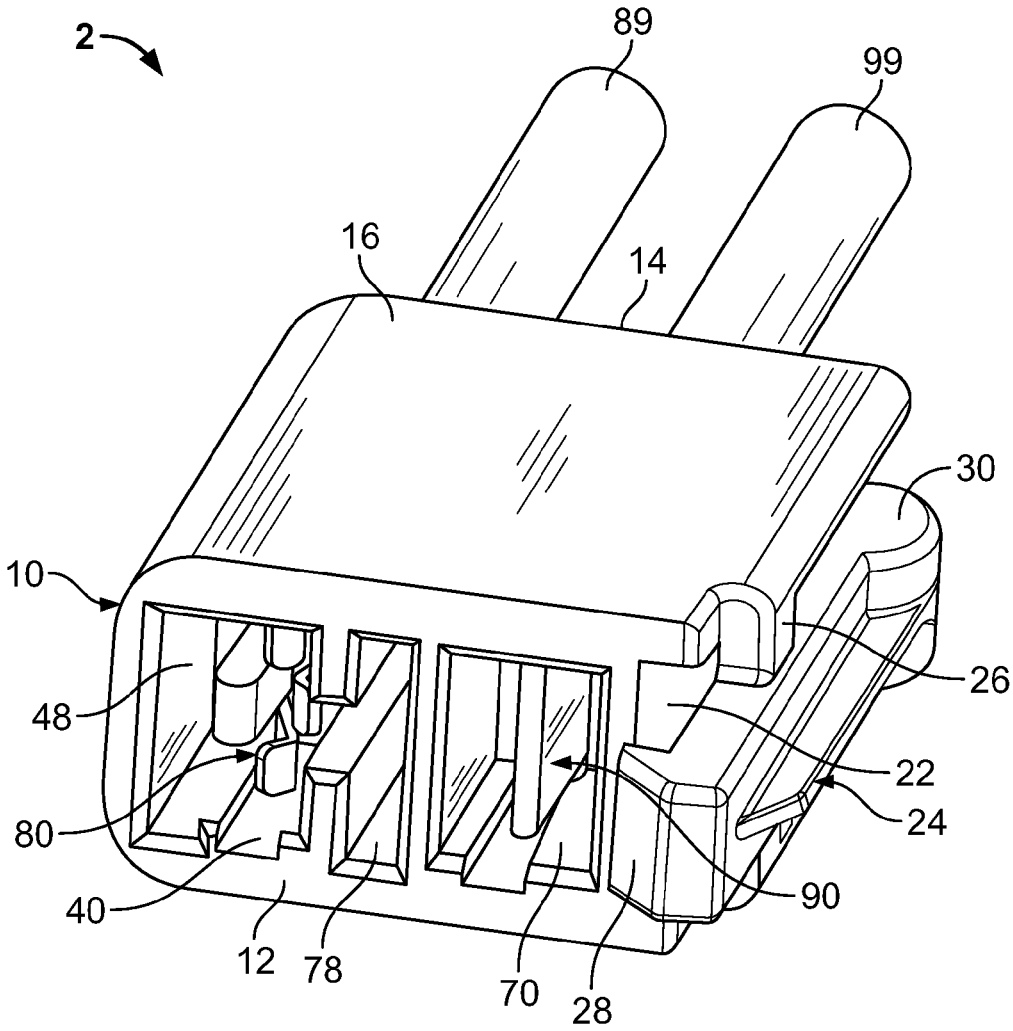
FIG. 1 is a front perspective of an embodiment of the plug connector according to the present invention.
Figure 5:
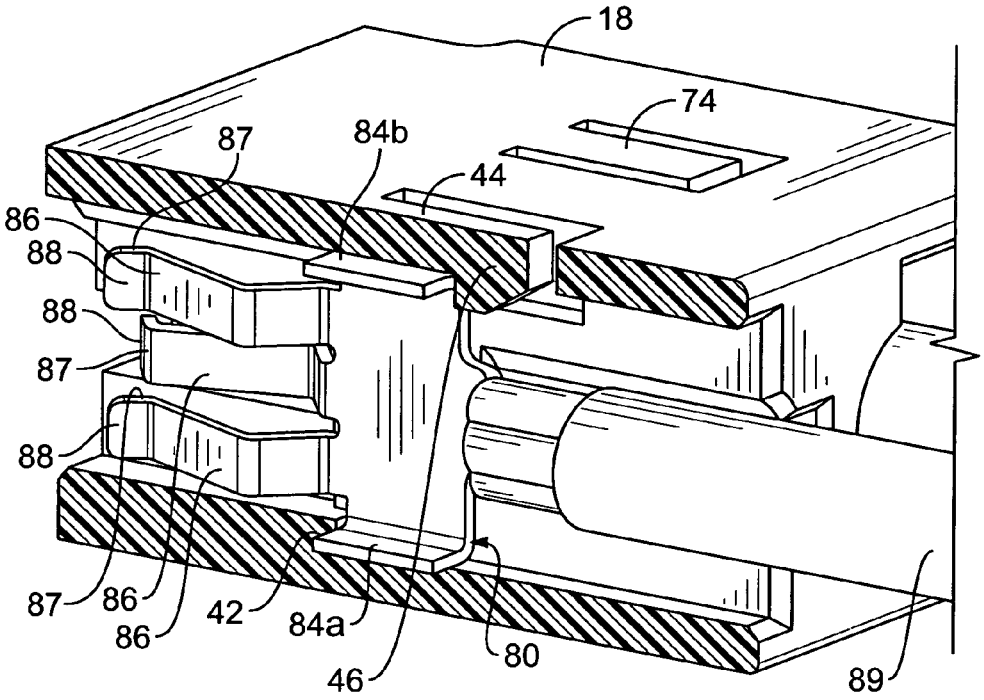
FIG. 5 is a perspective cross-sectional view of the housing taken along the longitudinal axis of a receptacle contact receiving cavity, with the receptacle contact positioned therein.
Figure 6:
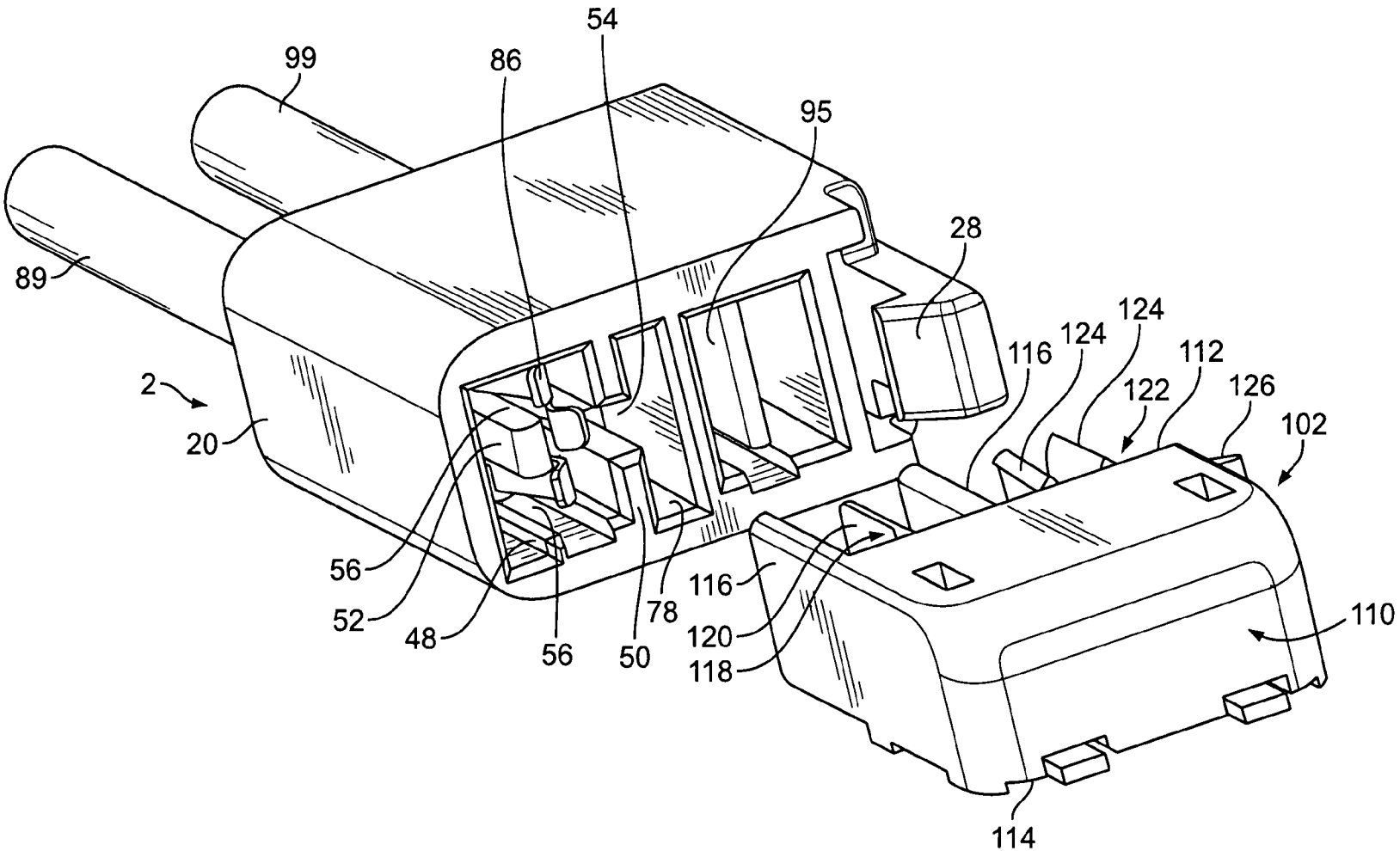
FIG. 6 is a perspective view of the plug connector and a mating connector prior to mating thereof.

Referring to FIGS. 1 and 6, a plug connector 2 has a housing 10 with a receptacle contact 80 and a blade contact 90 positioned therein. The housing 10 has a mating face 12 and an oppositely facing wire-receiving face 14. A first wall 16, an oppositely facing second wall 18 (FIG. 5), a first sidewall 20 and a second sidewall 22 extend from the mating face 12 to the wire-receiving face 14. As best shown in FIG. 1, a connector latching arm 24 is provided proximate second sidewall 22. The connector latching arm 24 has pivot members 26 which extend from the first wall 16 and the second wall 18. The pivot members 26 are positioned proximate the longitudinal center of the connector latching arm 24 to allow the connector latching arm 24 to pivot thereabout. A latching projection 28 is provided at an end of the connector latching arm 24 that is positioned proximate the mating face 12. A disengaging member 30 is provided at the opposite end of the connector latching arm 24.

Figure 3:
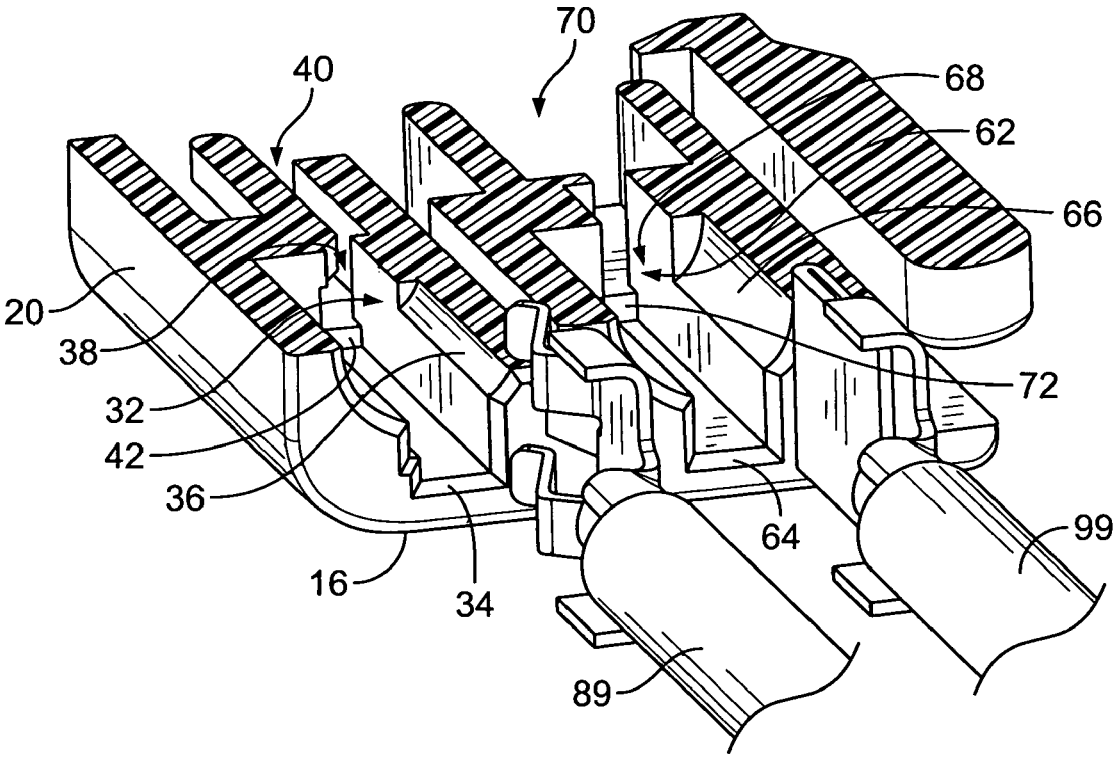
FIG. 3 is a perspective cross-sectional view of the housing taken along a centerline thereof, with the contacts removed therefrom.

As best shown in FIG. 3, the housing 10 has a receptacle contact receiving cavity 32 and a blade contact receiving cavity 62 that extends therethrough, from the wire-receiving face 14 to the mating face 12. The receptacle contact receiving cavity 32 has a lead-in surface 34 that extends from the wire-receiving face 14. Extending from the lead-in surface 34 toward the mating face 12, the receptacle contact receiving cavity 32 has a wire-receiving section 36, a securing section 38 and a mating contact receiving section 40. The securing section 38, as shown in FIG. 5, has a retention shoulder 42 and a contact latch arm 44 with a contact latch arm projection 46. Referring again to FIGS. 1 and 6, an alignment cavity 48 is provided adjacent the mating contact receiving section 40 of the receptacle contact receiving cavity 32.

Referring also to FIG. 6, the mating contact receiving section 40 has a first wall 50 and a second wall 52, spaced from the first wall 50, which partially define the mating contact receiving section 40. The first wall 50 has a slot 54 provided therein and the second wall 52 has two slots 56 provided therein. The slots 54, 56 allow for the movement of the receptacle contact 80, as will be more fully explained.

As best shown in FIG. 3, the blade contact receiving cavity 62 has a lead-in surface 64 that extends from the wire-receiving face 14. Extending from the lead-in surface 64 toward the mating face 12, the blade contact receiving cavity 62 has a wire-receiving section 66, a securing section 68 and a mating contact receiving section 70. The securing section 68 has a retention shoulder (not shown) similar to retention shoulder 42 (FIG. 5) and a contact latch arm 74 (FIG. 4) with a contact latch arm projection 76. Referring again to FIGS. 1 and 6, an alignment cavity 78 is provided adjacent the mating contact receiving section 70 of the blade contact receiving cavity 32.

Figure 2:
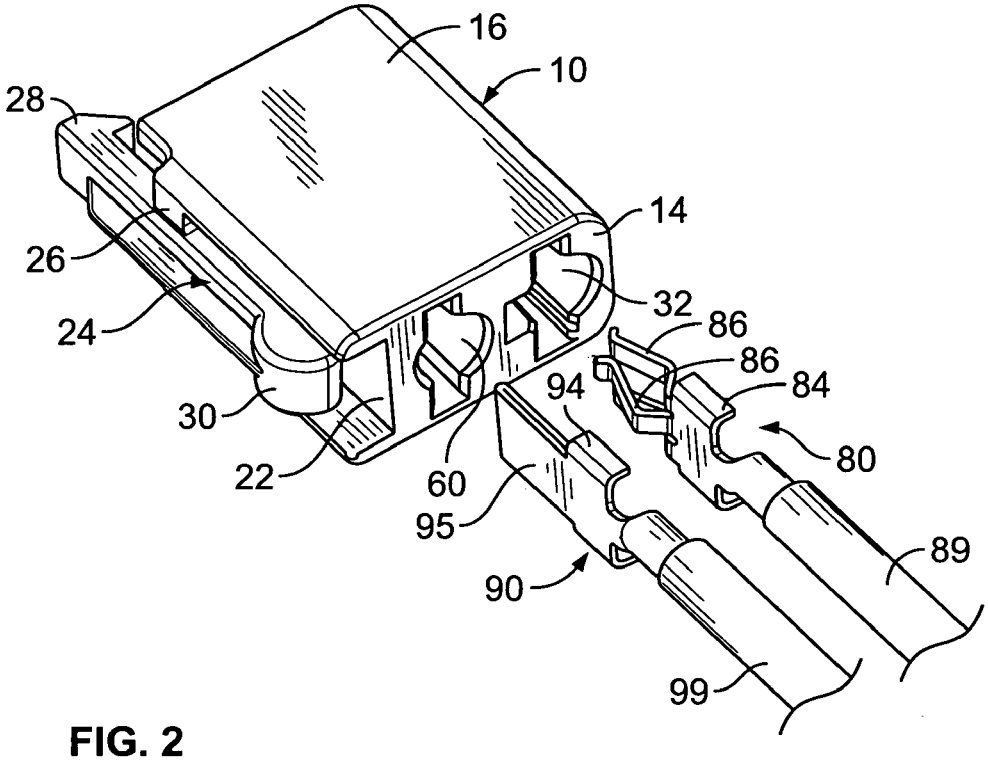
FIG. 2 is a back perspective of contacts of the plug connector removed from the housing.
Figure 4:
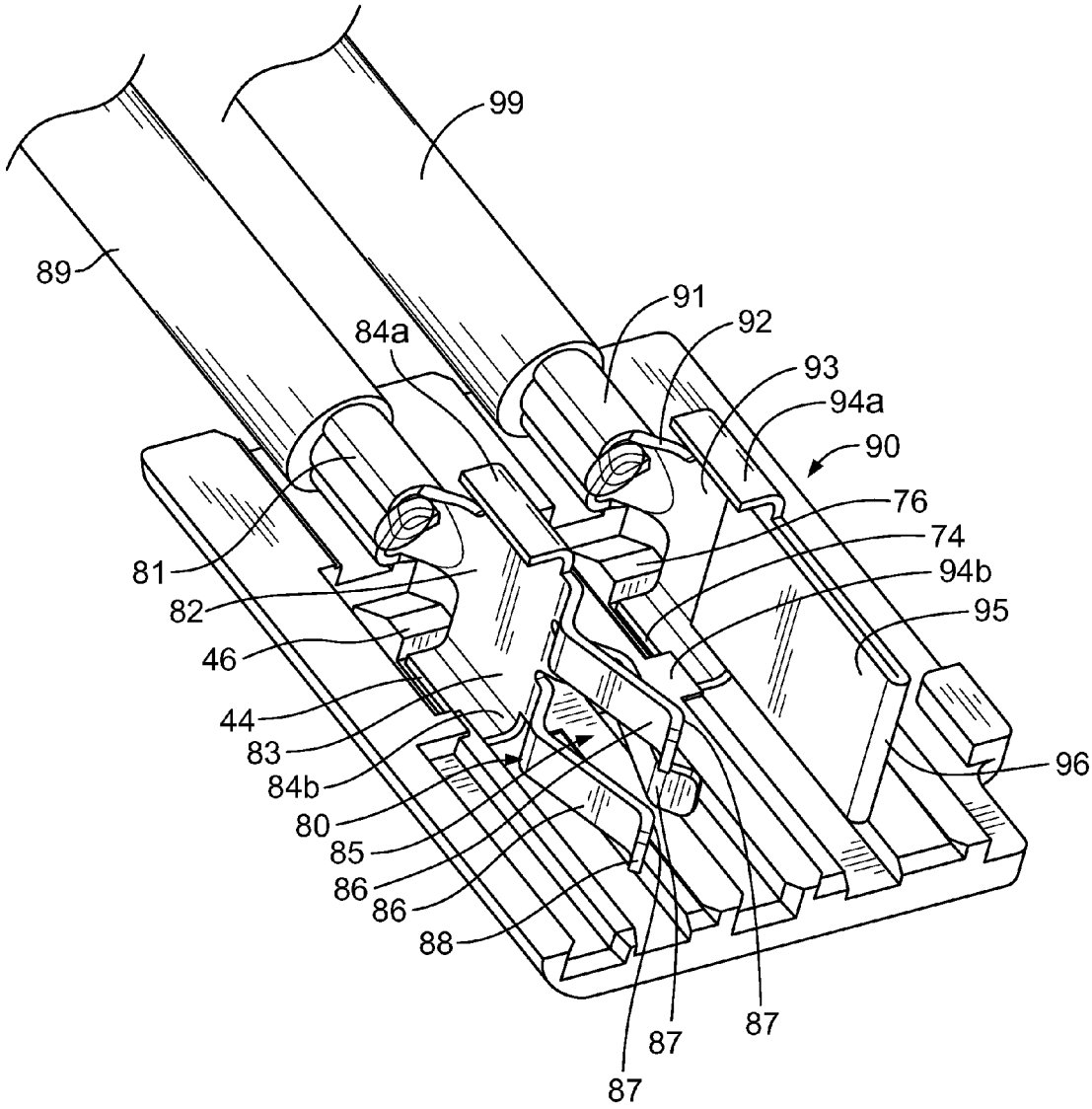
FIG. 4 is perspective view of the contacts in relation to a second wall of the housing, with the contacts positioned in cooperation contact latch arms.

As shown in FIGS. 2, 4 and 5, the receptacle contact 80 has a wire-receiving portion 81 that mechanically and electrically engages wire 89. The wire 89 is configured to conduct power therethrough. The wire-receiving portion 81 can be crimped to the wire 89 or can be terminated to the wire 89 in any other known manner. The wire-receiving portion 81 and a portion of the wire 89 are maintained in the wire-receiving section 36 of the receptacle contact receiving cavity 32. A transition portion 82 extends from the wire-receiving portion 81 to a mounting portion 83. The mounting portion 83 is offset from the center of the wire-receiving portion 81. Mounting shoulders 84*a*, 84*b* are provided on the mounting portions 83. As best shown in FIG. 5, the mounting shoulders 84*a*, 84*b* are prevented from movement along the longitudinal axis of the receptacle contact receiving cavity 32 by the cooperation of the retention shoulder 42 and the contact latch arm projection 46 of the securing section 38 of the housing 10. However, the use of the resilient contact latch arm 44 allows the receptacle contact 80 to be removed without damaging the housing 10. An operator moves the contact latch arm 44 and latch arm projection 46 from the receptacle contact receiving cavity 32, thereby allowing the receptacle contact 80 to be removed through the wire-receiving face 14. The resilient characteristics of the contact latch arm 44 allow for many such cycles. In the embodiment shown, the mounting shoulders 84*a*, 84*b* extend from the mounting portions 83 in a plane that is essentially perpendicular to the plane of the mounting portions 83. However, other configurations of the mounting shoulders 84*a*, 84*b* can be used without departing from the scope of the invention.

Contact section 85 extends from the mounting portion 83 in a direction away from the wire-receiving portion 81. The contact section 85 has resilient contact arms 86. In the embodiment shown, three resilient contact arms 86 are provided. The resilient contact arms 86 are positioned to be in alignment with respective slots 54, 56 of first wall 50 and second wall 52. The resilient contact arms 86 are bent to provide enhanced resilient characteristics. Each resilient contact arm 86 has a contact area 87 that is positioned to provide a mechanical and electrical connection with a mating contact. The contact areas 87 are positioned in an essentially linear alignment. Lead-in surfaces 88 extend from the contact areas 87 toward the mating face 12. Other configurations of the resilient contact arms may be used without affecting the performance of the plug connector. For example, any number of contact arms may be used and they may have contact areas 87 spaced from each other so that they are not provided in linear alignment.

During assembly of the plug connector 2, the wire 89 is terminated to the wire-receiving portion 81 of the receptacle contact 80. The receptacle contact 80 is then inserted through the wire-receiving face 14 into the receptacle contact receiving cavity 32. The lead-in surface 34 guides the receptacle contact 80, thereby facilitating the insertion. As the insertion continues, the mounting shoulder 84*a* engages the latch arm projection 46, causing the contact latch arm 44 to be resiliently displaced. As the other mounting shoulder 84*b* engages retention shoulder 42, the mounting shoulder 84*a* is moved past the latch arm projection 46, allowing the contact latch arm 44 to return to its unstressed position. With mounting shoulder 84*b* against retention shoulder 42 and mounting shoulder 84*a* against latch arm projection 46, as shown in FIG. 5, the receptacle contact 80 is retained in the receptacle contact receiving cavity 32.

The blade contact 90 has a wire-receiving portion 91 that mechanically and electrically engages wire 99. The wire 99 is configured to conduct power therethrough. The wire-receiving portion 91 can be crimped to the wire 99 or can be terminated to the wire 99 in any other known manner. The wire-receiving portion 91 and a portion of the wire 99 are maintained in the wire-receiving section 66 of the blade contact receiving cavity 62. A transition portion 92 extends from the wire-receiving portion 91 to a mounting portion 93. The mounting portion 93 is offset from the center of the wire-receiving portion 91. Mounting shoulders 94*a*, 94*b* are provided on the mounting portions 93. In the same manner shown in FIG. 5 with respect to mounting shoulders 84*a*, 84*b*, the mounting shoulders 94*a*, 94*b* are prevented from movement along the longitudinal axis of the blade contact receiving cavity 62 by the cooperation of the retention shoulder and the contact latch arm projection 76 of the securing section 68 of the housing 10. However, the use of the resilient contact latch arm 74 allows the blade contact 90 to be removed without damaging the housing 10. An operator moves the contact latch arm 74 and latch arm projection 76 from the blade contact receiving cavity 62, thereby allowing the blade contact 90 to be removed through the wire-receiving face 14. The resilient characteristics of the contact latch arm 74 allow for many such cycles. In the embodiment shown, the mounting shoulders 94*a*, 94*b* extend from the mounting portions 93 in planes that are essentially perpendicular to the plane of the mounting portions 93. However, other configurations of the mounting shoulders 94*a*, 94*b* can be used without departing from the scope of the invention.

Contact section 95 extends from the mounting portion 93 in a direction away from the wire-receiving portion 91. The contact section 95 is essentially a blade that is bent back upon itself to provide a contact section 95 that has a thickness of twice the material thickness of the blade contact 90. A folded front end 96 is provided; the folded front end 96 has an arcuate shape that helps to prevent stubbing of the blade contact when it is mated to a mating contact. Other configurations of the contact section may be used without affecting the performance of the plug connector. For example, the contact section may have contact areas that project therefrom.

During assembly of the plug connector 2, the wire 99 is terminated to the wire-receiving portion 91 of the blade contact 90. The blade contact 90 is then inserted through the wire-receiving face 14 into the blade contact receiving cavity 62. The lead-in surface 64 guides the blade contact 90, thereby facilitating the insertion. As the insertion continues, the mounting shoulder 94*b* engages the latch arm projection 76, causing the contact latch arm 74 to be resiliently displaced. As the other mounting shoulder 94*a* engages retention shoulder 72 (FIG. 3), the mounting shoulder 94*b* is moved past the latch arm projection 76, allowing the latch arm 74 to return to its unstressed position. With mounting shoulder 94*a* against retention shoulder 72 and mounting shoulder 94*b* against latch arm projection 76, as shown in FIG. 5, the blade contact 90 is retained in the blade contact receiving cavity 62.

Referring to FIGS. 1, 3 and 6, when the plug connector 2 is fully assembled, the receptacle contact receiving cavity 32 and the blade contact receiving cavity 62 are isolated from each other by portions of the housing 10. This helps to prevent short circuiting or the like between the receptacle contact 80 and the blade contact 90 as the power is conducted thereon.

Figure 7:
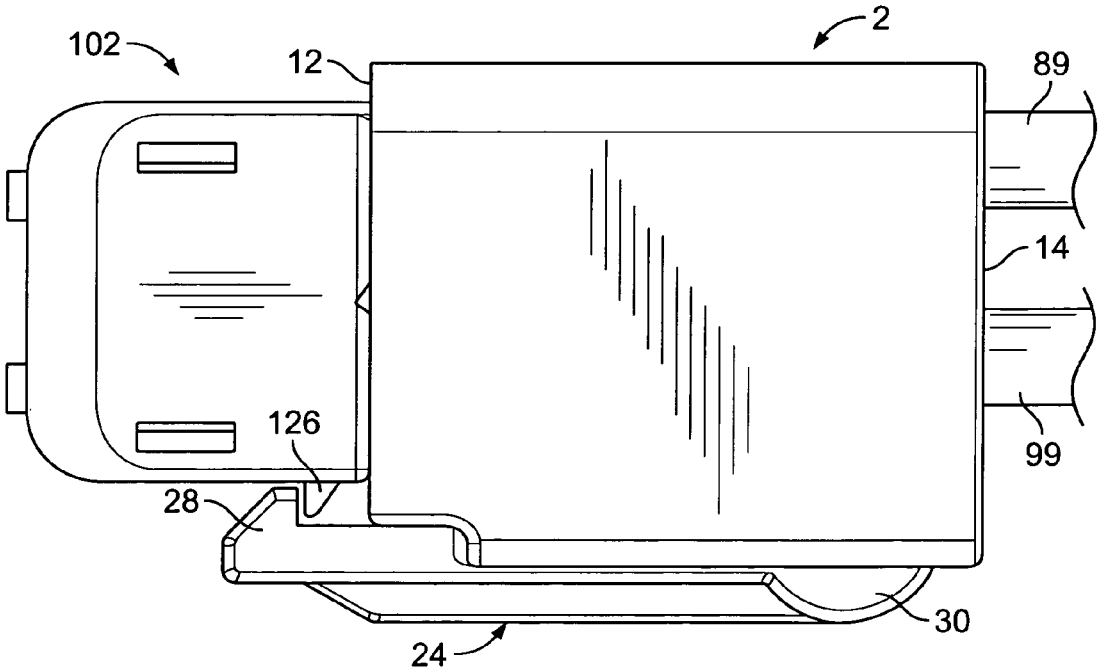
FIG. 7 is a top view of the plug connector and mating connector in their fully mated position.
Figure 8:
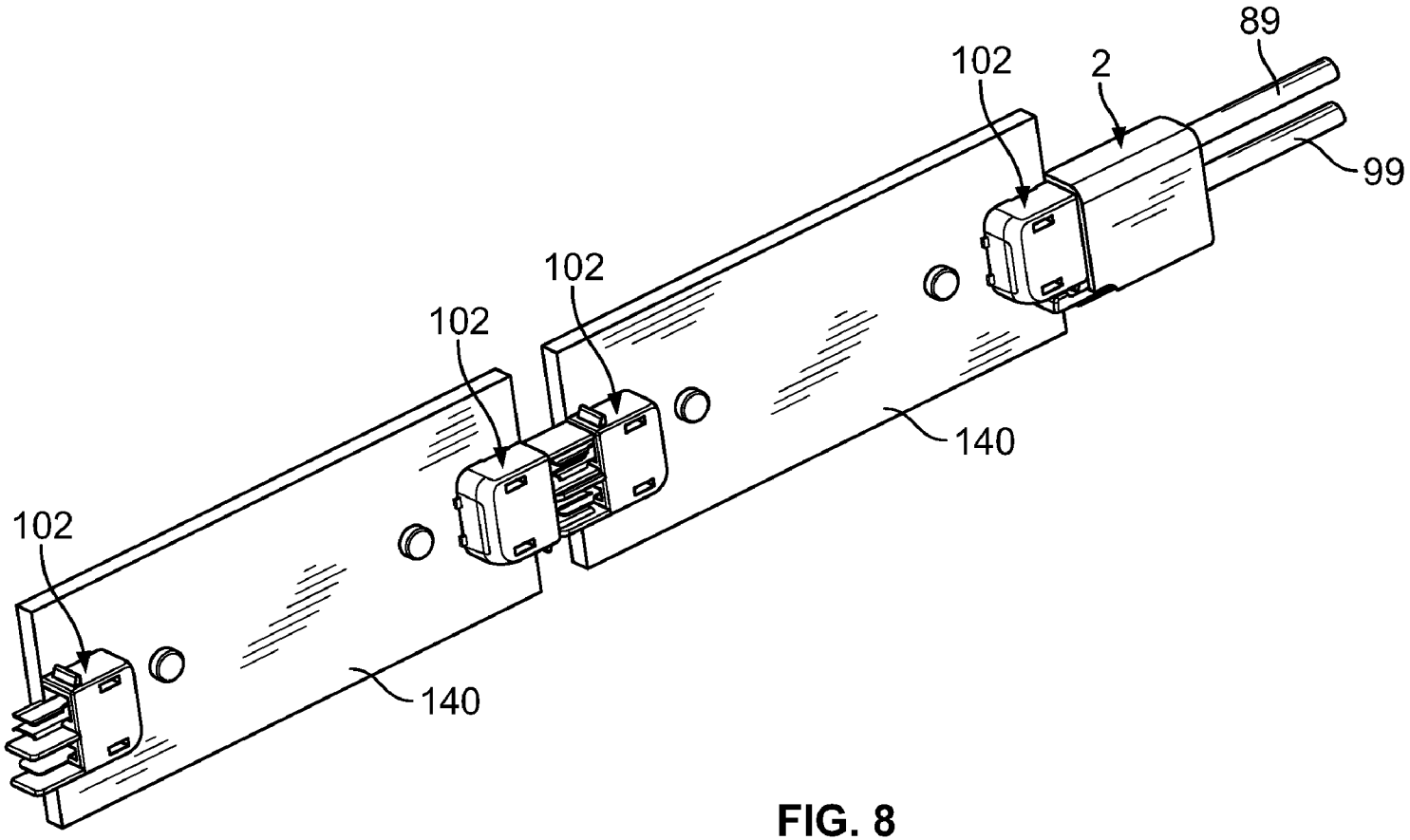
FIG. 8 illustrates a series of printed circuit boards electrically connected by mating connectors, with plug connector of the present invention mated with a respective mating connector, the plug connector supplying the power required.

The plug connector 2 is configured to connect to a mating connector 102 as is shown in FIGS. 7 and 8. The mating connector, as best shown in FIG. 6, has a housing 110 with a connector mating face 112 and a board engagement face 114. Alignment projections 116 extend from the connector mating face 112 in a direction that is essentially perpendicular to the connector mating face 112. Contact section 120 of a mating blade contact 118 and contact arms 124 of a mating receptacle contact 122 also extend from the connector mating face 112. A latch shoulder extends from a sidewall of the housing 110 proximate the connector mating face 112.

As the plug connector 2 and mating connector 102 are moved into engagement, the alignment projections 116 are moved into the respective alignment cavities 48, 78. If the plug connector 2 and mating connector 102 are not properly aligned, the alignment projections 116 will not enter the alignment cavities, thereby preventing the improper mating of the plug connector 2 to the mating connector 102. With the plug connector 2 and mating connector 102 properly aligned, the insertion of the alignment projections 116 into the alignment cavities 48, 78 continues, allowing the receptacle contact 80 of the plug connector 2 to engage the blade contact 118 of mating connector 102, and the blade contact 90 of the plug connector 2 to engage the receptacle contact 122 of the mating connector 102. As the alignment projections 116 are partially positioned in the alignment cavities 48, 78 prior to the engagement of the contacts, the housing 10 and alignment projections 116 continue the isolation of the respective mating contacts as mating occurs and as the power is conducted across the contacts.

As the receptacle contact 80 and the blade contact 118 are moved together, the blade contact 118 engages the lead-in surfaces 88 of the resilient contact arms 86, causing them to move apart. As the resilient contact arms 86 are resiliently displaced outward, the resilient contact arms 86 are moved into the slots 54, 56 of first wall 50 and second wall 52. The cooperation of the slots 54, 56 with the resilient contact arms 86 allows the centerline spacing between the receptacle contact 80 and the blade contact 90 to be identical to the centerline spacing of the blade contact 118 and the receptacle contact 122 of the mating connector 102. Without slots 54, 56, the first wall 50 and the second wall 52 would be spaced further apart to allow the resilient contact arms 86 to move. The increased spacing would alter the spacing of the alignment cavities 48, 78 and the spacing of the contacts 80, 90, thereby preventing the plug connector 2 from mating with the mating connector 102.

As insertion continues, the contact areas 87 slide across the contact section 120 of blade contact 118. As the contact areas 87 are biased against the contact section 120 by the resilient displacement of the resilient contact arms 86, the contact areas 87 provide a wiping action, thereby removing any contamination or debris that is present on the contact section 120 or the contact area.

As the blade contact 90 and the receptacle contact 122 are moved together, the receptacle contact 122 engages the folded front end 96 of the blade contact 90, causing the resilient contact arms 124 of the receptacle contact 122 to move apart. As the resilient contact arms 124 are resiliently displaced outward, the resilient contact arms 124 slide across the contact section 95 of the blade contact 90. As the resilient contact arms 124 are biased against the contact section 95, the resilient contact arms 124 provide a wiping action, thereby removing any contamination or debris that is present on the contact section 95 or the resilient contact arms 124.

As the plug connector 2 and the mating connector 102 approach their fully mated position, the latching projection 28 of the connector latching arm 24 is resiliently displaced by the latch shoulder 126. When the fully mated position is reached, latching projection 28 is moved beyond the latch shoulder 126 and the connector latching arm 24 is returned to its unstressed position, positioning the latching projection 28 behind the latch shoulder 126. The cooperation of the latching projection 28 and the latch shoulder 126 prevents the unwanted disengagement of plug connector 2 from mating connector 102. The use of the connector latching arm 24 allows an operator to easily unmate the plug connector 2 from the mating connector 102, thereby allowing for ease in maintenance and repair of the circuit boards 140 and other components.

The use of the plug connector 2 has many advantages, including the ability to provide power to a string of circuit boards or other systems using mating connectors already used on the circuit boards. The use of the plug connector 2 eliminates the user's need to solder power leads to the circuit board, thereby providing a much more reliable and effective source of power. As the plug connector 2 can be easily disengaged when desired, the ability to repair or replace the circuit boards or other components is enhanced.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An electrical connector comprising:

a housing having contact receiving cavities extending from a wire-receiving face to a mating face, alignment cavities positioned adjacent the contact receiving cavities, the alignment cavities extending from the mating face toward the wire-receiving face;

contacts positioned in the contact receiving cavities, the contacts having wire-receiving portions and contact sections, the contact sections being positioned in the contact receiving cavities proximate the mating face;

a connector latch arm extending from the housing, the connector latch arm having a latch projection proximate the mating face, the latch projection being movable relative to the housing; and the contact receiving cavities having latch arm projections and retention shoulders which extend into securing sections of the contact receiving cavities, the latch arm projections and the retention shoulders cooperating with mounting shoulders of the contacts to retain the contacts in the contact receiving cavities, the latch arm projections being provided on contact latch arms which can be resiliently displaced to move the latch arm projections out of the contact receiving cavities, thereby allowing the contacts to be removed from the contact receiving cavities.

2. The electrical connector as recited in claim 1 wherein at least one contact receiving cavity has walls which define a mating contact receiving area, the walls having slots extending therethrough.

3. The electrical connector as recited in claim 2 wherein at least one contact is positioned in the at least one contact receiving cavity, the at least one contact having resilient contact arms which align with the slots of the walls and which move into the slots of the walls when a mating connector is mated with the at least one contact.

4. The electrical connector as recited in claim 1 wherein a first at least one contact is a blade contact and a second at least one contact is a receptacle contact.

5. The electrical connector as recited in claim 1 wherein the wire-receiving portions have power wires terminated thereto.

6. An electrical connector comprising:

a housing having at least one receptacle contact receiving cavity and at least one blade receiving contact cavity extending from a wire-receiving face to a mating face, alignment cavities positioned adjacent the at least one receptacle contact receiving cavity and the at least one blade contact receiving cavity, the alignment cavities extending from the mating face toward the wire-receiving face, the at least one receptacle contact receiving cavity having walls which define a mating contact receiving area, the walls having slots extending therethrough;

a receptacle contact positioned in the at least one receptacle contact receiving cavity, the receptacle contact having a receptacle wire-receiving portion and receptacle contact section, the receptacle contact section being positioned in the at least one receptacle contact receiving cavity proximate the mating face;

a blade contact positioned in the at least one blade contact receiving cavity, the blade contact having a blade wire-receiving portion and a blade contact section, the blade contact section being positioned in the at least one blade contact receiving cavity proximate the mating face; and a connector latch arm extending from the housing, the connector latch arm having a latch projection proximate the mating face, the latch projection being movable relative to the housing.

7. The electrical connector as recited in claim 6 wherein the at least one receptacle contact receiving cavity has a first latch arm projection and a first retention shoulder which extend into the at least one receptacle contact receiving cavity, the first latch arm projection and the first retention shoulder cooperate with a receptacle mounting shoulder of the receptacle contact to retain the receptacle contact in the at least one receptacle contact receiving cavity.

8. The electrical connector as recited in claim 7 wherein the first latch arm projection is provided on a first contact latch arm which can be resiliently displaced to move the first latch arm projection out of the at least one receptacle contact receiving cavity, thereby allowing the receptacle contact to be removed from the at least one receptacle contact receiving cavity.

9. The electrical connector as recited in claim 6 wherein the at least one blade contact receiving cavity has a second latch arm projection and a second retention shoulder which extend into the at least one blade contact receiving cavity, the second latch arm projection and the second retention shoulder cooperate with a blade mounting shoulder of the blade contact to retain the blade contact in the at least one blade contact receiving cavity.

10. The electrical connector as recited in claim 9 wherein the second latch arm projection is provided on a second contact latch arm which can be resiliently displaced to move the second latch arm projection out of the at least one blade contact receiving cavity, thereby allowing the blade contact to be removed from the at least one blade contact receiving cavity.

11. The electrical connector as recited in claim 10 wherein the receptacle contact has resilient contact arms which align with the slots of the walls and which move into the slots of the walls when a mating connector is mated with the receptacle contact.

12. The electrical connector as recited in claim 6 wherein the receptacle wire-receiving portion and the blade wire-receiving portion have power wires terminated thereto.

13. An electrical connector comprising:

a housing having at least one receptacle contact receiving cavity extending from a wire-receiving face to a mating face, at least one alignment cavity positioned adjacent the at least one receptacle contact receiving cavity, the at least one alignment cavity extending from the mating face toward the wire-receiving face, the at least one receptacle contact receiving cavity having walls which define a mating contact receiving area, the walls having slots extending therethrough; and a receptacle contact positioned in the at least one receptacle contact receiving cavity, the receptacle contact having a receptacle wire-receiving portion and receptacle contact section, the receptacle contact section being positioned in the at least one receptacle contact receiving cavity proximate the mating face; the receptacle contact has resilient contact arms which align with the slots of the walls and which move into the slots of the walls when a mating connector is mated with the receptacle contact.

14. The electrical connector as recited in claim 13 wherein the at least one receptacle contact receiving cavity has a first latch arm projection and a first retention shoulder which extend into the at least one receptacle contact receiving cavity, the first latch arm projection and the first retention shoulder cooperate with a receptacle mounting shoulder of the receptacle contact to retain the receptacle contact in the at least one receptacle contact receiving cavity.

15. The electrical connector as recited in claim 14 wherein the first latch arm projection is provided on a first contact latch arm which can be resiliently displaced to move the first latch arm projection out of the at least one receptacle contact receiving cavity, thereby allowing the receptacle contact to be removed from the at least one receptacle contact receiving cavity.

16. The electrical connector as recited in claim 13 wherein a connector latch arm extends from the housing, the connector latch arm having a latch projection proximate the mating face, the latch projection being movable relative to the housing.

17. The electrical connector as recited in claim 13 wherein the receptacle wire-receiving portion has a power wire terminated thereto.

* * * * *